US005581994A

United States Patent [19]

Reiss et al.

[11] Patent Number: 5,581,994

[45] Date of Patent: Dec. 10, 1996

[54] METHOD FOR COOLING A COMPONENT AND APPLIANCE FOR CARRYING OUT THE METHOD

[75] Inventors: Frank Reiss, Lauchringen, Germany; Stefan Tschirren, Thalheim, Switzerland

[73] Assignee: ABB Management AG, Baden, Switzerland

[21] Appl. No.: 290,129

[22] Filed: Aug. 15, 1994

[30] Foreign Application Priority Data

Aug. 23, 1993 [DE] Germany ..... 43 28 294.6

[51] Int. Cl.[6] ..... F23R 3/02

[52] U.S. Cl. ..... 60/39.02; 60/752

[58] Field of Search ..... 60/39.02, 752, 60/757, 759, 760, 754, 758; 165/908

[56] References Cited

U.S. PATENT DOCUMENTS

| | | | |
|---|---|---|---|
| 4,339,925 | 7/1982 | Eggmann et al. | 60/760 |
| 4,719,748 | 1/1988 | Davis, Jr. et al. | 60/758 |
| 4,872,312 | 10/1989 | Iizuka et al. | 60/754 |
| 4,896,510 | 1/1990 | Foltz | 60/757 |
| 4,916,905 | 4/1990 | Havercroft | 60/757 |
| 5,363,653 | 11/1994 | Zimmermann et al. | 60/760 |

FOREIGN PATENT DOCUMENTS

3803086A1 8/1988 Germany .

2836539C2 5/1990 Germany .

OTHER PUBLICATIONS

"Cooling Structure of Combustor of Gas Turbine", Pat. Abstracts of Japan, M-1118, May 30, 1991, vol. 15, No. 212.

"Cooling Structure for Tail of Combustor", Pat. Abstracts of Japan, M-752, Oct. 12, 1988, vol. 12, No. 381.

*Primary Examiner*—Timothy S. Thorpe

*Attorney, Agent, or Firm*—Burns, Doane, Swecker & Mathis

[57] ABSTRACT

In a method for cooling a thermally loaded component (1) with a plate-type outer wall (2), in which method cooling air is supplied, in a first cooling section (A) of the component (1), through a cooling air supply (5) in the direction towards the outer wall (2) and is deflected laterally before the outer wall (2) and in a second cooling section (B) is further guided parallel to the outer wall (2) in a laterally adjoining cooling air duct (3) for the purpose of further cooling, homogenization of the cooling is achieved wherein, in order to reduce the impingement cooling in the first cooling section (A), the cooling airflow coming from the cooling airsupply (5) is subdivided into a main flow and a by-pass flow, the main flow is guided directly along the outer wall (2) of the component (1) to the cooling air duct (3), the by-pass flow is guided to the cooling air duct (3) without contacting the outer wall (2) and both partial flows are recombined at the inlet to the cooling air duct (3).

15 Claims, 4 Drawing Sheets

12
13
14
15
16
17
18
19
20
21
22
23
24
25
26
27
28

METHOD FOR COOLING A COMPONENT AND APPLIANCE FOR CARRYING OUT THE METHOD

BACKGROUND OF THE INVENTION

1. Field of the Invention

The present invention relates to the field of mechanical engineering, in particular of thermal machines. It concerns a method for cooling a thermally loaded component with a plate-type outer wall, in which method cooling air is supplied, in a first cooling section of the component, through a cooling air supply in the direction towards the outer wall and is deflected laterally in front of the outer wall and in a second cooling section is further guided parallel to the outer wall in a laterally adjoining cooling air duct for the purpose of further cooling.

Such a method for cooling the hot-gas casing and turbine inlet of a gas turbine is known, for example, from the German Offenlegungsschrift DE-A1 28 36 539.

The invention also concerns an appliance for carrying out the method.

2. Discussion of Background

In thermally loaded components of machines, for example the shells of the hot-gas casing and the turbine inlet for a gas turbine, cooling is frequently provided by means of cooling air. The cooling air then flows (FIG. 1) parallel to the outer wall 2 of the component 1, for the purpose of convective cooling, in a cooling air duct 3 along the outer wall 2. The cooling air duct 3 is, for example, formed by the outer wall 2 and a duct wall 6 in the form of a guide plate surrounding the outer wall 2 at a distance.

In the gas turbine, the cooling air usually originates from the compressor part and flows from the so-called plenum, which surrounds the hot-gas casing, into the cooling air duct 3. For this purpose, a gap-shaped opening is usually left free as the cooling air supply 5 between the duct wall 6 and the opposite boundary wall 4 at the inlet to the cooling air duct 3. The cooling air can enter the cooling air duct 3 through the cooling air supply 5. Because of the geometry present, the cooling air has, as a rule, a vertical velocity component in the region of the cooling air supply 5 so that the cooling air impinges, more or less strongly, on the outer wall 2 of the component 1 before entry into the cooling air duct 3 and is only subsequently deflected into the laterally outgoing cooling air duct 3.

The impingement results, on the one hand, in particularly effective impingement cooling on the outer wall 2 and, on the other hand, there is no cooling at all at the stagnation point of the incoming cooling air so that the component 1 is very inhomogeneously cooled in the first cooling section A in which this impingement cooling takes place. This inhomogeneous cooling causes additional and generally undesirable loads on the component.

SUMMARY OF THE INVENTION

Accordingly, one object of this invention is to provide a novel method which leads to homogenization of the cooling relationships in the cooling of the type mentioned at the beginning and also to propose an appliance for carrying out this method.

The object is achieved in a method of the type mentioned at the beginning, wherein, in order to reduce the impingement cooling in the first cooling section, the cooling airflow coming from the cooling air supply is subdivided into a main flow and a by-pass flow, the main flow is guided directly along the outer wall of the component to the cooling air duct, the by-pass flow is guided to the cooling air duct without contacting the outer wall and both partial flows are recombined at the inlet to the cooling air duct.

The core of the invention consists in designing the cooling in the first cooling section so that it can be matched to the cooling in the second cooling section by a chosen subdivision of the total cooling air into a first partial flow, which takes part in the impingement cooling, and a second partial flow which is transferred directly into the cooling air duct without impingement cooling.

A particularly even transition between the two sections is achieved if, in accordance with a preferred embodiment of the method according to the invention, the main flow is additionally composed of a plurality of small partial flows which are distributed over the first cooling section and are branched off from the incoming cooling air flow.

The appliance according to the invention for carrying out the method is one wherein (a) a partition is arranged parallel to the outer wall and at a distance from the latter from the beginning of the cooling air duct into the region of the cooling air supply, which partition subdivides the space between the cooling air supply and the cooling air duct into a main duct and a by-pass duct extending parallel to the latter;

(b) the main duct being formed by the outer wall of the component and the partition; and (c) the by-pass duct extending outside the partition.

A first preferred embodiment of the appliance according to the invention is one wherein the partition reaches sufficiently far into the region of the cooling air supply for it to form, together with the opposite boundary wall of the cooling air supply, a supply opening whose width is smaller than the width of the cooling air supply. This permits the cooling effectiveness in the first cooling section to be fixed particularly simply by the choice of a single width.

A second preferred embodiment of the appliance according to the invention is one wherein a multiplicity of adjacent holes are provided in the partition and cooling air can flow through them into the main duct. This provides a particularly even transition between the two cooling sections.

A third preferred embodiment is one wherein the component is a thermally loaded part of a gas turbine, wherein the gas turbine has a turbine part, a combustion chamber and a turbine inlet leading from the combustion chamber to the turbine part, which turbine inlet guides the hot combustion gases and is formed from an inner shell and an outer shell, and wherein the cooled component is the inner shell and/or the outer shell of the turbine inlet. Particularly favorable cooling relationships can be achieved in a gas turbine by means of the appliance according to the invention.

Further embodiments are given by the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
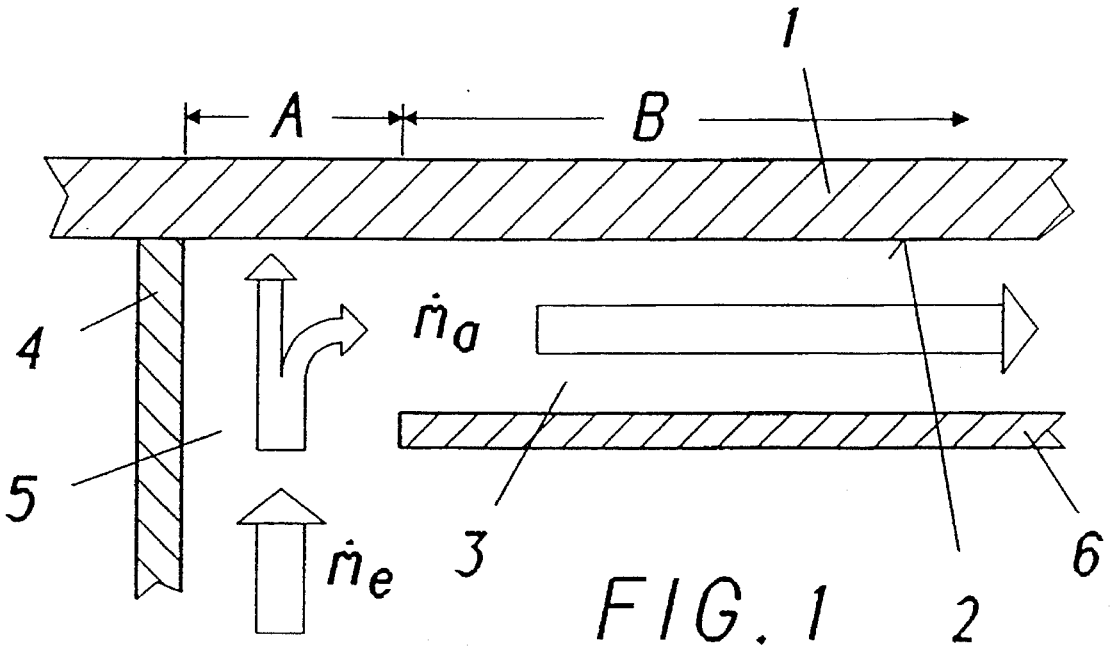
FIG. 1 shows the diagram of conventional air cooling with mainly impingement cooling in the first cooling section and pure convection cooling in the second cooling section.

Referring now to the drawings, wherein like reference numerals designate identical or corresponding parts throughout the several views, a greatly simplified diagram of conventional cooling is reproduced, as excerpt, in FIG. 1. The problem on which the present invention is based can be explained by means of this diagram. The starting point is a thermally loaded component 1, for example a shell or wall, which is to be cooled by a flow of cooling air. For this purpose, a duct wall 6, extending parallel to the outer wall 2 of the component 1 and at a distance from the outer wall 2, is provided outside the component 1 and this duct wall 6, together with the outer wall 2, forms a cooling air duct 3. The cooling air flows through the cooling air duct 3 substantially parallel to the outer wall 2 and cools the component 1 by convective cooling (the cooling air flow are indicated by the arrows which have been drawn in).

The cooling air for the cooling air duct 3 is supplied from a source (not represented) along a boundary wall 4 through a cooling air supply 5. The supply usually takes place in such a way that the cooling air impinges vertically or at least with a vertical velocity component onto the outer wall 2, is deflected laterally and flows into the laterally adjoining cooling air duct 3. The mass flow supplied $dm_e/dt$ (the differential coefficients of the masses m are abbreviated for space reasons, in known manner, by placing a point above them in FIG. 1 and likewise in the further FIGS. 2 to 4) is then fed unchanged as the outgoing mass flow $dm_a/dt$ into the cooling air duct 3.

In the construction represented in FIG. 1, there is - due to the geometry of the cooling air supply very effective impingement cooling in a first cooling section A which is located directly opposite the cooling air supply 5 whereas, in an adjacent second cooling section B, which coincides with the region of the cooling air duct 3, less effective convection cooling is present. The result of these different cooling effectivenesses is that the component 1 is very inhomogeneously cooled overall, i.e. there is a markedly lower temperature in the first cooling section A than in the cooling section B.

The present invention provides a way in which these inhomogeneities can be simply and effectively reduced or completely obviated. The core of the invention can be made clear by using the representation of FIG. 2, which shows a diagrammatic cooling device comparable with FIG. 1. In this case, the incoming cooling air flow $dm_e/dt$ is subdivided behind the cooling air supply 5 into a main flow ($dm_1/dt$) and a by-pass flow ($dm_2/dt$). Whereas the main flow is initially brought directly into contact with the outer wall 2 in a main duct 11 and is subsequently fed into the cooling air duct 3, the by-pass flow is guided through a by-pass duct 8, by-passes the outer wall 2 and is guided directly to the inlet of the cooling air duct 3. In this way, the proportion of impingement cooling can be reduced, adjusted in a defined manner or made to disappear completely.

The separation of the space between the cooling air supply 5 and the inlet of the cooling air duct 3 advantageously takes place by means of a partition 7 which is, for example, arranged parallel to the outer wall 2 and at a distance from it. The partition 7 then reaches from the beginning of the cooling air duct 3 into the region of the cooling air supply 5 and ends, in a preferred embodiment, at a distance in front of the opposite boundary wall 4 so that there is a supply opening 10 with a width C for the main flow. This width C is smaller than the width D of the cooling air supply 5. The duct wall 6 is expediently extended to the beginning of the cooling air duct 3 and its extended region overlaps the partition 7, whose distance from the outer wall 2 is advantageously less than the corresponding distance of the duct wall 6. This ensures, in a simple manner, that main flow and by-pass flow are supplied to the cooling air duct 3. The size of the main flow relative to the total cooling airflow depends, in this case, on the ratio of the width C of the supply opening 10 to the width D of the cooling air supply 5 and can be easily adapted to the requirements.

Holes 9 with a distributed arrangement are provided in the partition 7 in addition to or as an alternative to the supply opening 10 and a mass flow $dm_3/dt$ in the form of small partial flows passes successively through the holes 9 from the by-pass duct 8 into the main duct 11. The hole density and the size and depth of the individual holes 9 are then also available as a parameter for the adjustment of the cooling effectiveness in the deflection region. The partition 7, which is usually designed as a sheet-metal part, then acts as a by-pass plate or an impingement plate.

Figure 2:
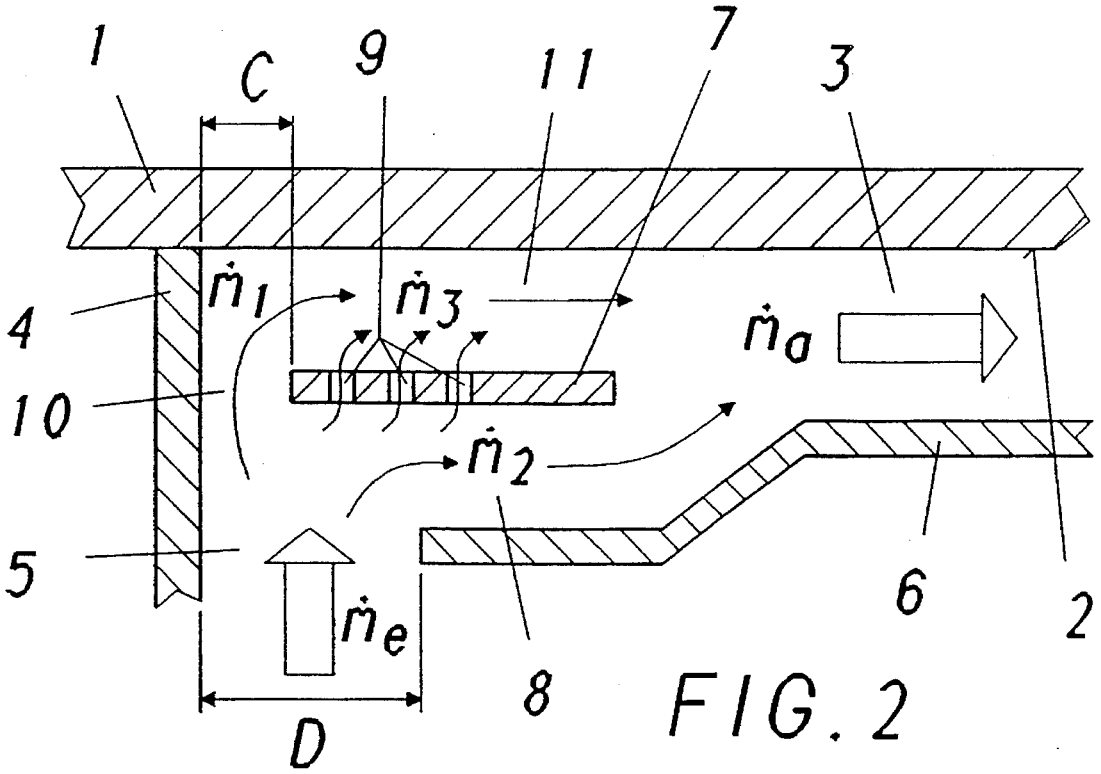
FIG. 2 shows the diagram of a first embodiment example of the appliance according to the invention with vertical arrival of the cooling air and perforated partition.

Whereas, in the embodiment example of FIG. 2, the included angle between the boundary wall 4 and the outer wall 2 of the component 1 is 90°and, therefore, the cooling air supplied meets the outer wall practically at right angles, the invention can also be generally applied in the cases where the included angle deviates from 90°, i.e. is either obtuse (for example up to 170°) or acute (for example down to 10°). The two cases are reproduced in an indicative manner in FIG. 3 and 4. It is self-evident that in these cases, particularly in the case of the obtuse angle, the impingement cooling is less strongly marked because the velocity component of the flow at right angles to the outer wall 2, which determines the impingement cooling, is correspondingly less.

The homogenization according to the invention of the cooling can be applied particularly advantageously to thermally loaded components of gas turbines, in particular the shells of the turbine inlet arranged between the combustion chamber and the turbine part. Embodiment examples for such an application are reproduced in FIG. 5 (outer shell of the turbine inlet) and in FIG. 6 (inner shell of the turbine inlet).

Figure 5:
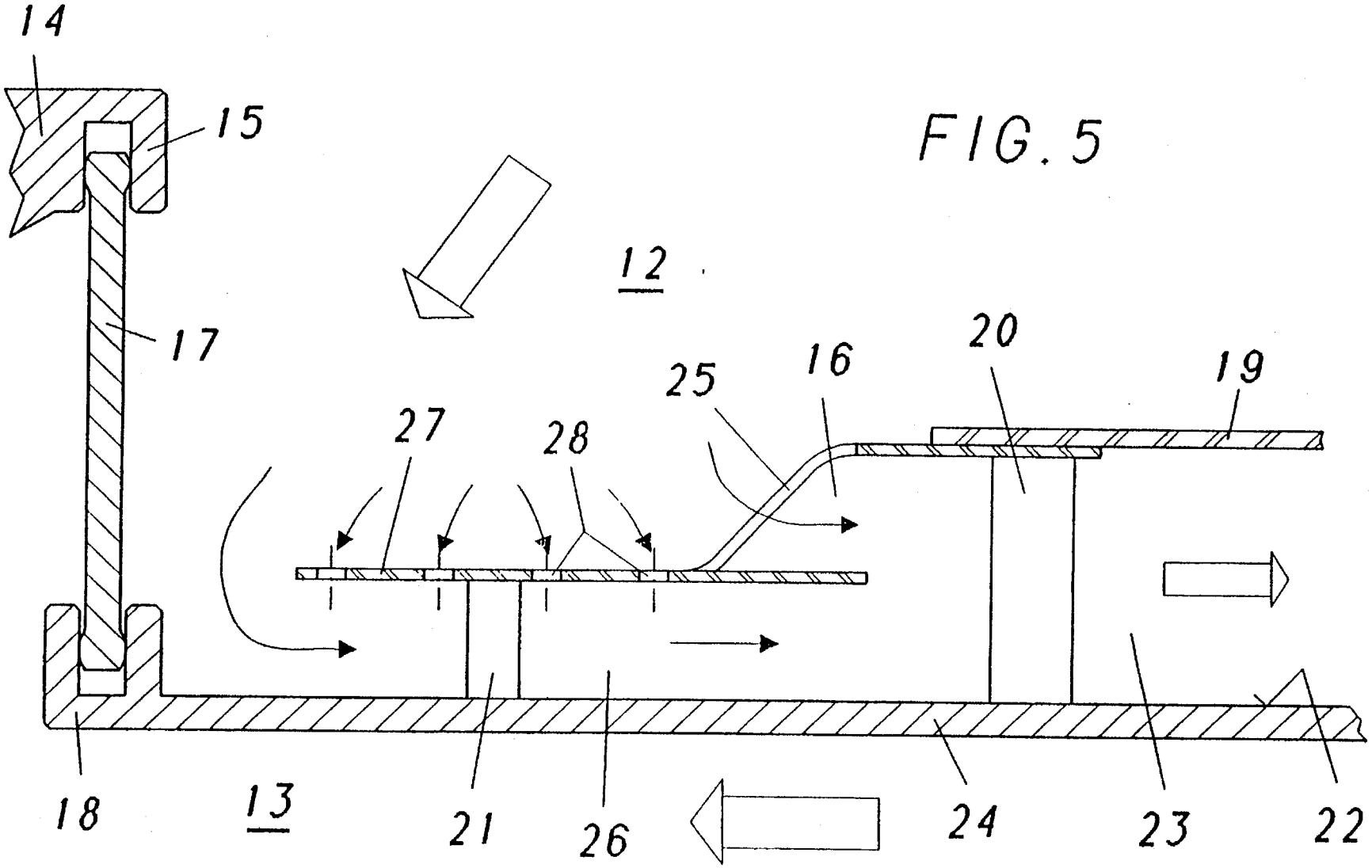
FIG. 5 shows, in longitudinal section, an embodiment example of the cooling, according to the invention, on the outer shell of the turbine inlet of a gas turbine.

The outer part of a turbine inlet 13 represented (as excerpt) in longitudinal section in FIG. 5 includes the outer shell 24 as the component to be cooled. The outer shell 24 bounds, towards the outside, the space through which the hot gases are fed from the combustion chamber into the turbine part (from right to left in the figure). The outer shell 24 is surrounded on the outside by a guide plate 19, which is supported by means of distance pieces 20 on the outer shell 24 and extends approximately parallel to the shell at a distance fixed by the distance pieces 20. The cooling air duct 23, through which cooling air flows along the outer shell 24, is located between the guide plate 19 and the outer wall 22 of the outer shell 24.

At its end facing towards the turbine part, the outer shell 24 merges into an inner segment support 18 in which a plurality of sealing segments 17 are supported, in an annular arrangement, by means of an appropriately configured bottom piece. On the other side the sealing segments 17 are supported in an outer segment support 15 which is part of a vane carrier 14, which carries the guide vanes (not shown) of the turbine part.

The outer shell 24 with the guide plate 19 is surrounded on the outside by the so-called plenum 12 of the turbine, and this plenum 12 contains compressed air from the compressor part, which air is used as both combustion air and cooling air. The cooling air for cooling the outer shell 24 flows from the plenum 12 into the cooling air duct 23 and is deflected in the process. In this process the sealing segments 17 undertake the function of the boundary wall 4 of FIG. 1 to 4. Together with the outer shell 24, they form a right angle in the example represented (comparable to the situation represented in FIG. 2). In order to ensure that the cooling air does not impinge excessively on the outer shell 24 in the deflection area, a partition 27 in sheet-metal form is arranged there. The partition 27 extends parallel to the outer wall 22 of the outer shell and, specifically, at a distance which is smaller than the distance of the guide plate 19 from the outer wall 22. It is likewise supported by means of distance pieces 21 on the outer shell 24 and defines the main duct 26 between itself and the outer wall 22.

Figure 3:
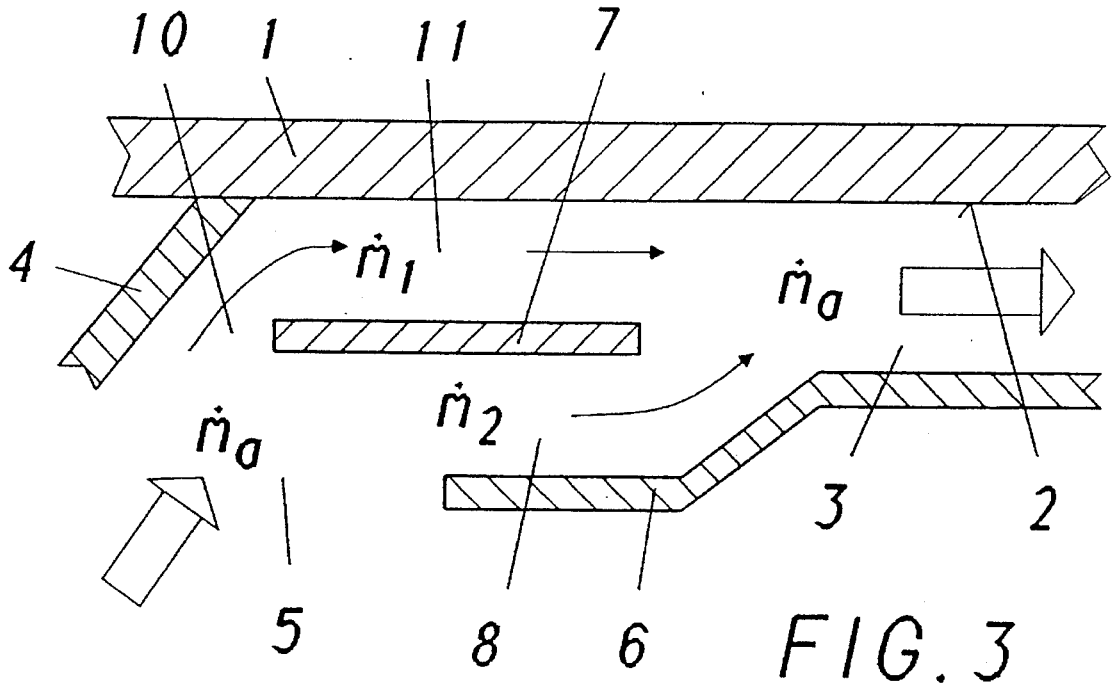
FIG. 3 shows a diagram comparable with FIG. 2 with a deflection angle greater than 90°.
Figure 4:
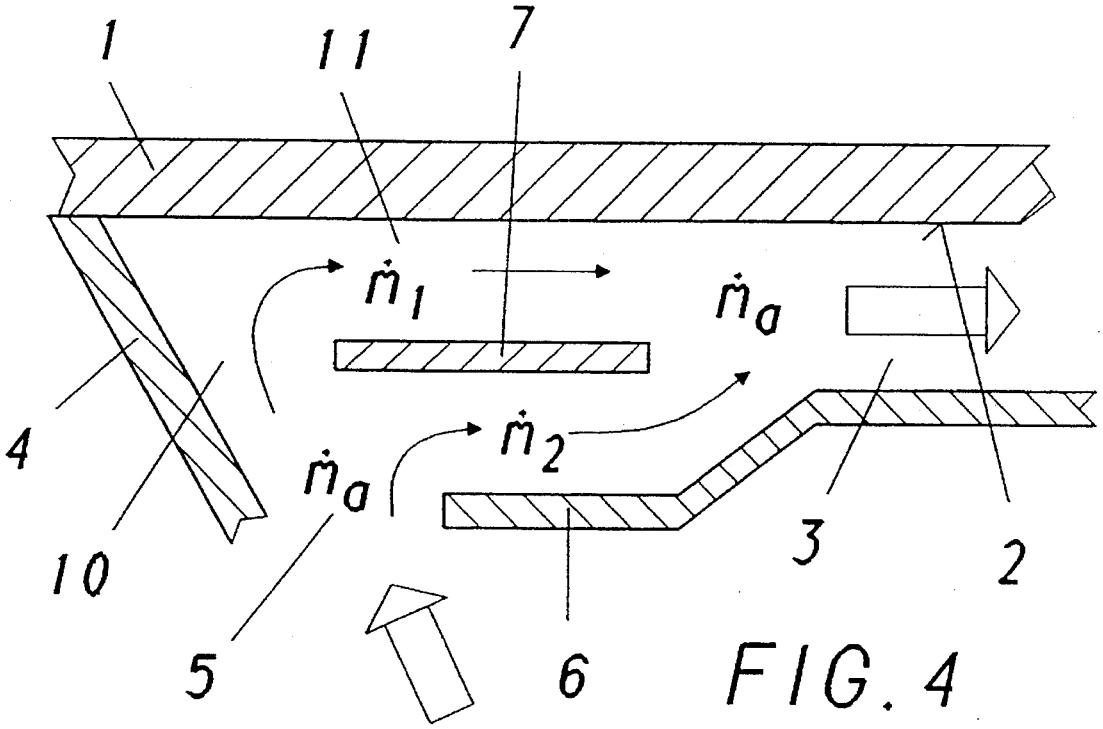
FIG. 4 shows a diagram comparable with FIG. 2 with a deflection angle less than 90°.

At one of its ends, the partition 27 does not quite extend to the opposite sealing elements 17 so that cooling air can flow into the main duct 26 through the gap there, which corresponds to the supply opening 10 of FIG. 2 to 4. At the other end, the partition 27 reaches into the opening of the cooling air duct 23 so that a short by-pass duct 41 is formed between the partition 27 and the periphery of the guide plate 19. A stable fastening for the partition 27 in this region can be achieved by bending up an end section of the sheet metal, which is connected to the rest of the sheet metal by means of a strap 25, and fixing it, together with the start of the guide plate 19, to the distance pieces 20. In addition, the partition 27 is provided with uniformly distributed holes 28 in this embodiment example and cooling air can reach the main duct 26 in small partial flows through these holes 28.

Figure 6:
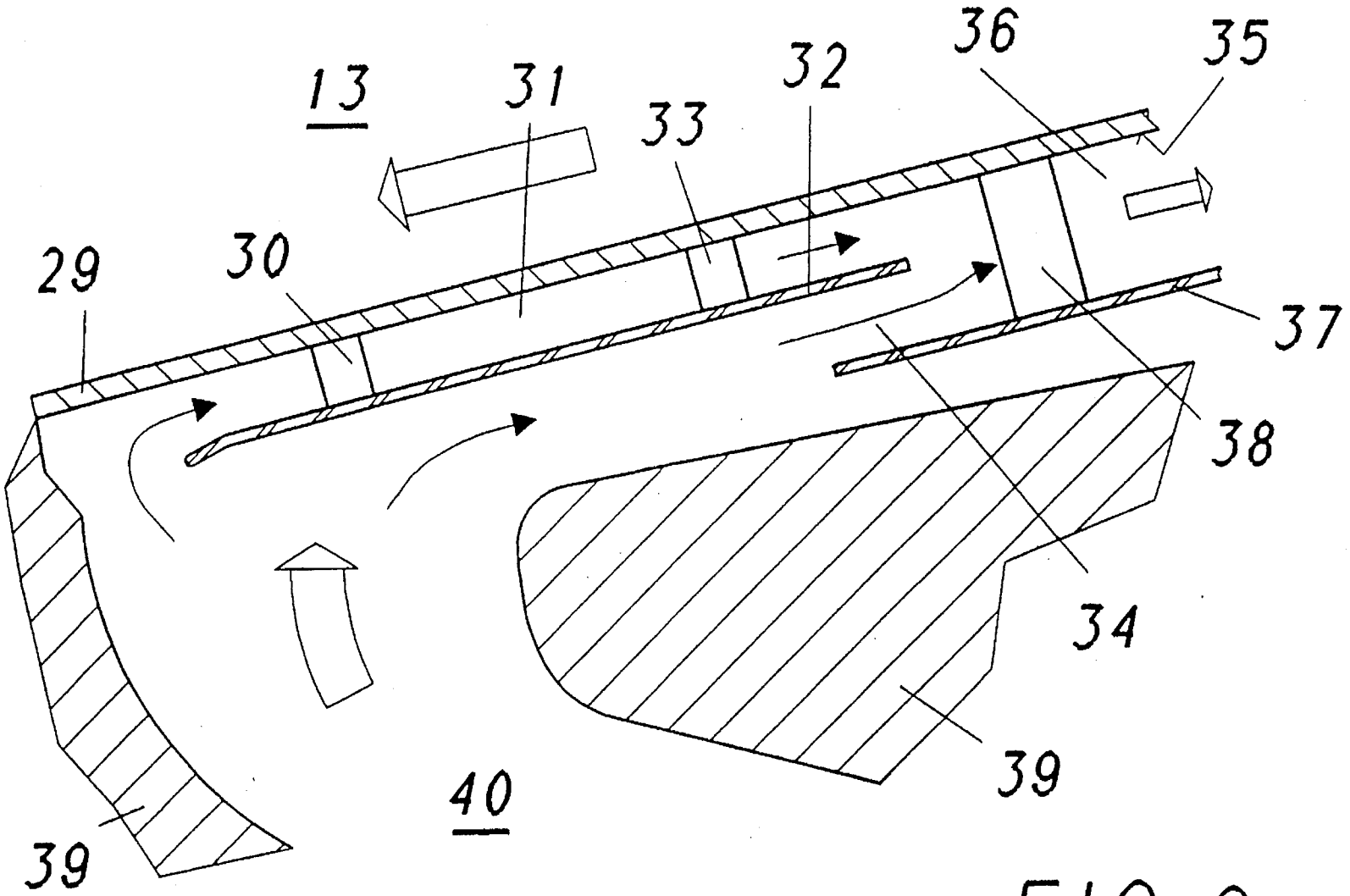
FIG. 6 shows, in longitudinal section, an embodiment example of the cooling, according to the invention, on the inner shell of the turbine inlet of a gas turbine.

The application of the principle according to the invention to the inner shell of the turbine inlet 13 is represented as an embodiment example in FIG. 6. The inner shell 29 surrounds the turbine casing 39. A duct-type cooling air supply 40, through which the cooling air flows onto the outer wall 35 of the inner shell 29, is provided in the turbine casing. The actual cooling again takes place in a cooling air duct 36 which is formed by the inner shell 29 and a guide plate 37 surrounding it at a distance. A partition 32 made of sheet-metal is again used here for reducing the impingement cooling in the deflection region. This partition 32 preferably extends parallel to the inner shell 29 and has a smaller distance from it than the guide plate 37. Both the partition 32 and the guide plate 37 are supported on the inner shell 29 by means of distance pieces 30, 33 and 38.

On one side, the partition 32 bounds the main duct 31. On the other side, it again overlaps the guide plate 37 so as to form a short by-pass duct 34. In this example, holes are not provided in the partition but they can be readily inserted in addition in order to increase the cooling effect in the deflection region.

Overall, the invention provides an effective means of achieving homogenization of the cooling in thermally loaded components in which cooling air coming from the outside must be deflected into a cooling air duct extending parallel to the surface of the component.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States:

1. A method for cooling a thermally loaded component having a plate-type outer wall and a duct wall parallel to the outer wall defining a cooling duct therebetween, a first cooling section comprising a portion of the outer wall and a second cooling section adjacent to the first cooling section comprising the cooling duct, the method comprising the steps of:

supplying a cooling air flow from a cooling air supply;

dividing the cooling air flow into a main flow and a by-pass flow, the main flow being directed to impinge on the outer wall in the first cooling section, wherein the main flow is deflected at the first cooling section toward the cooling duct, and the by-pass flow being directed to the cooling air duct without contacting the outer wall in the first cooling section;

guiding the by-pass flow to the cooling duct to recombine with the main flow; and directing the recombined cooling air flow in the cooling duct parallel to the outer wall.

2. The method as claimed in claim 1, wherein the main flow is guided as a single, coherent flow.

3. The method as claimed in claim 1, further comprising the step of dividing the main flow into a plurality of partial flows distributed over the first cooling section to impinge on the outer wall.

4. An apparatus for cooling an outer wall of a thermally loaded component, comprising:

a cooling air supply duct for guiding cooling air from a cooling air supply to the outer wall of the component;

a duct wall disposed adjacent to the outer wall to define a cooling air duct bounded by the outer wall and the duct wall, the cooling air duct having an inlet communicating with the supply duct; and a partition disposed parallel to and spaced from the outer wall and extending from the cooling air supply duct to the inlet of the cooling duct, the partition defining a main duct adjacent to the outer wall and a by-pass duct parallel to the main duct and separated from the outer wall by the partition.

5. The apparatus as claimed in claim 4, wherein an end of the partition at the cooling air supply and an opposite boundary wall of the cooling air supply define a supply opening directed to the outer wall and having a cross sectional flow area that is smaller than a cross sectional flow area of the cooling air supply.

6. The apparatus as claimed in claim 5, wherein a ratio of a cooling air mass flow in the main duct and a cooling air mass flow in the by-pass duct is determined by the cross sectional flow area of the supply opening.

7. The apparatus as claimed in claim 4, wherein the partition has a multiplicity of holes for flows of cooling air into the main duct.

8. The apparatus as claimed in claim 4, wherein a distance between the partition and the outer wall of the component is less than a distance between the outer wall and the duct wall.

9. The apparatus as claimed in claim 4, wherein a portion of the duct wall overlaps a portion of the partition.

10. The apparatus as claimed in claim 4, wherein the component is a thermally loaded part of a gas turbine apparatus.

11. The apparatus as claimed in claim 10, wherein the gas turbine apparatus has a turbine part, a combustion chamber and a turbine inlet leading from the combustion chamber to the turbine part, which turbine inlet guides hot combustion gases and is formed by an inner shell and an outer shell, and wherein the cooled component is at least one of the inner shell and the outer shell of the turbine inlet.

12. The apparatus as claimed in claim 11, wherein the duct wall comprises a guide plate supported by distance pieces mounted on the outer wall of the outer shell.

13. The apparatus as claimed in claim 12, wherein the partition comprises a plate supported by distance pieces mounted on the outer wall of the outer shell.

14. The apparatus as claimed in claim 11, wherein the duct wall comprises a guide plate supported by distance pieces mounted on the outer wall of the inner shell.

15. The apparatus as claimed in claim 14, wherein the partition comprises a plate supported by distance pieces mounted on the outer wall of the outer shell.

* * * * *